United States Patent [19]

Shannon

[11] Patent Number: 5,058,782

[45] Date of Patent: Oct. 22, 1991

[54] SYRUP DISPENSING SYSTEM

[75] Inventor: Joseph W. Shannon, Kent, Ohio

[73] Assignee: ABC/Sebrn Techcorp., Akron, Ohio

[21] Appl. No.: 498,438

[22] Filed: Mar. 26, 1990

[51] Int. Cl.[5] ..... B65D 11/00

[52] U.S. Cl. ..... 222/330; 222/397; 222/399

[58] Field of Search ..... 222/108-110, 222/129.1-129.4, 397, 399, 394, 571, 71, 640, 330; 99/323.1, 323.2

[56] References Cited

U.S. PATENT DOCUMENTS

| | | | |
|---|---|---|---|
| 3,119,485 | 1/1964 | Bayers, Jr. | 222/129.4 |
| 3,823,571 | 7/1974 | Smith et al. | 222/129.3 |
| 4,211,342 | 7/1980 | Jamgochian et al. | 222/148 |
| 4,276,999 | 7/1981 | Reichenberger | 222/129.4 |

FOREIGN PATENT DOCUMENTS

| | | | |
|---|---|---|---|
| 2192860 | 1/1988 | United Kingdom | 222/129.1 |

*Primary Examiner*—Michael S. Huppert
*Assistant Examiner*—Philippe Derakshani
*Attorney, Agent, or Firm*—Renner, Kenner, Greive, Bobak, Taylor & Weber

[57] ABSTRACT

A syrup dispensing system provides dual dispensing lines to a dispensing head and drawn from a single pump. The lines are interconnected by means of a suitable manifold or other connector to allow intercommunication between the two. A single valve is interposed between the connector and the dispensing pump. Each of the dispensing lines extends upwardly to an apex and then downwardly to the dispensing head, with the dispensing head and apex being above the top syrup level of the pump. By venting the pump to atmosphere after termination of a dispensing cycle and then opening the dispensing valve, syrup backflows to the pump and past the respective apexes to prevent unwanted dripping of syrup during quiescent periods of the syrup dispensing system.

5 Claims, 1 Drawing Sheet

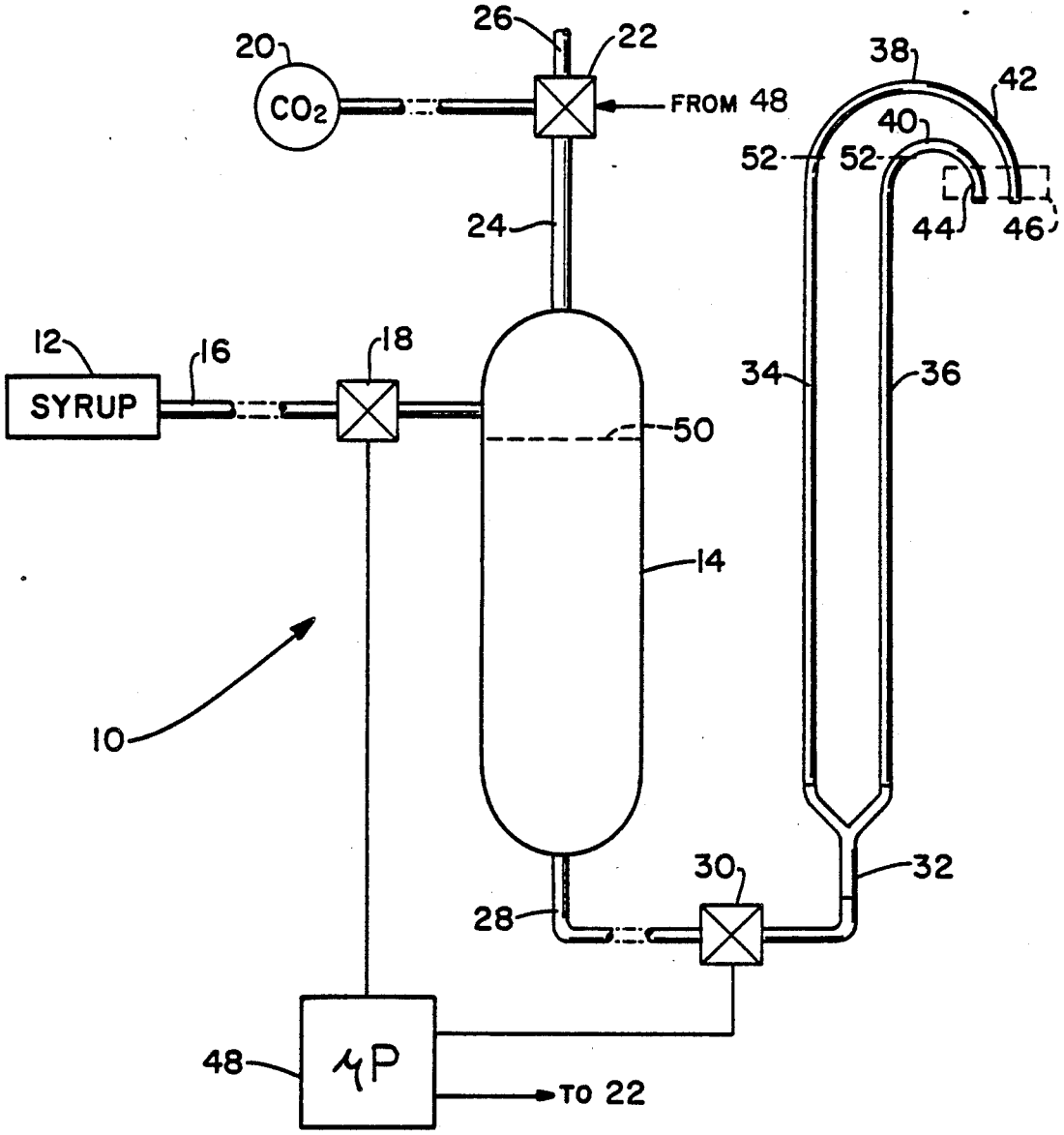
26
22
20
$CO_2$
FROM 48
38
42
40
52
52
44
46
24
12
16
18
SYRUP
34
36
50
14
10
30
32
28
48
μP
TO 22

SYRUP DISPENSING SYSTEM

TECHNICAL FIELD

The invention herein resides in the art of beverage dispensing apparatus and, more particularly, to a syrup dispenser for use in a soft drink dispensing system.

BACKGROUND ART

Various types of soft drink dispensers have been previously known. In such systems, a dispensing head or pour head contains dispensing lines for syrup and soda, the same being combined either in the pour head itself or in the cup positioned therebeneath. Of particular concern in many soft drink dispensers is the fact that the open ends of syrup dispensing lines are present in the pour head, the same typically being filled to the open end with syrup awaiting the next dispensing cycle. The syrup is maintained in the line by an appropriate vacuum and/or surface tension. However, it is known that present systems often allow syrup to drop from the open lines in the pour head. Should such syrup drop into a cup beneath the pour head into which a soft drink not requiring such syrup is being dispensed, the result is most undesirable.

In modern efficient soft drink dispensers, two or more streams of syrup are ejected into the cup alongside a central stream of soda. It has been found that each of the syrup lines necessary for this type of dispensing has required its own dispensing valve in order to prevent intersyphoning of syrup from one dispensing line to the other. There was no previously known way of assuring that the syrup in each of the dispensing lines was maintained at the same level, while also providing the benefit of reducing costs and maintenance by replacing the plural dispensing valves with a single valve.

Accordingly, there is a need in the art for a syrup dispensing system for use in soft drink dispensers in which a single syrup dispensing valve can be employed, undesired dripping can be prevented, and side-to-side syphoning of syrup from one line to the other can be obviated.

DISCLOSURE OF INVENTION

In light of the foregoing, it is a first aspect of the invention to provide a syrup dispensing system which prevents syrup from dripping from the dispensing lines of the pour head.

Another aspect of the invention is the provision of a syrup dispensing system which prevents syphoning from one syrup dispensing line to another in a soft drink dispenser employing plural syrup dispensing lines.

Yet an additional aspect of the invention is the provision of a syrup dispensing system in which a plurality of syrup dispensing lines at a pour head can be associated with a single syrup and pump, and employing a single dispensing valve.

Still a further aspect of the invention is the provision of a syrup dispensing system which is reliable and durable in operation, conducive to implementation with state of the art apparatus, and efficient and cost effective in implementation.

The foregoing and other aspects of the invention which will become apparent as the detailed description proceeds are achieved by a syrup dispensing system for a soft drink dispenser, comprising: a pump receiving a supply of syrup to a first level; a first dispensing line having a first end thereof in communication with said pump, and a second end thereof maintained at a pour head, said first dispensing line having an apex defining a second level in said dispensing line, said second level being above said first level; and a first valve interposed between said first dispensing line and said pump, selectively enabling and inhibiting a flow of syrup from said pump and through said first dispensing line.

Other aspects of the invention which will become apparent herein are attained by a syrup dispensing system, comprising: a pump for receiving said syrup and dispensing the same under pressure through a conduit; a plurality of dispensing lines connected to said conduit and extending to a dispensing head, said dispensing lines being connected to and communicating with each other through a connector; and a valve interposed within said conduit for enabling and inhibiting a flow of syrup from said pump to said plurality of dispensing lines.

DESCRIPTION OF DRAWING

For a complete understanding of the objects, techniques and structure of the invention reference should be made to the following detailed description and accompanying drawing wherein a schematic diagram of the invention is shown.

BEST MODE FOR CARRYING OUT THE INVENTION

Referring now to the drawing, it can be seen that a syrup dispensing system according to the invention is designated generally by the numeral 10. It will be appreciated that the system 10 would typically be employed in association with a soda dispensing system, the two joining to form a soft drink dispenser as is well known to those skilled in the art. In any event, the syrup dispensing system 10 includes a bulk supply of syrup 12 maintained under an appropriate pressure head provided by means of an appropriate gas or mechanical pump.

Syrup from the bulk supply 12 is passed to a dispensing pump 14 which, as now known in the art, comprises a tubular or cylindrical member. A conduit 16 interconnects the bulk supply 12 with the pump 14, with an appropriate valve 18 interposed therein. It will be appreciated by those skilled in the art, the valve 18 may comprise a solenoid valve which is electrically actuated.

Also comprising a portion of the system 10 is a pressure source 20 of carbon dioxide ($CO_2$) gas or the like. The pressure container 20 communicates through a three-way valve 22 to a conduit 24 which communicates with a top portion of the pump 14. The valve 22 also communicates to the atmosphere through an exhaust conduit or port 26.

Extending from a bottom end of the pump 14 is an outlet conduit 28 having a solenoid valve 30 maintained therein. The valve 30 is interposed in the conduit 28 between the pump 14 and a connector 32 which, in the embodiment shown, is a "Y" connector, but the same could be a "T" connector or other suitable type of manifold. As shown, the connector 32 interconnects the conduit 28 with a pair of dispensing lines 34, 36. While two such dispensing lines are presented in the preferred embodiment of the invention, it will be understood that any plurality of such dispensing lines could be connected to an appropriate connector 32.

As shown in the drawing, the dispensing lines 34, 36 extend generally upward from the pump 14 to respective apexes 38, 40, and then extend downwardly in the respective areas 42, 44 to a dispensing head 46, shown in phantom. It will, of course, be appreciated that the dispensing head 46 would also contain dispensing lines of other syrup pumps and from a soda system such that various types of soft drinks could be dispensed.

It should be noted that the apexes 38, 40 of the dispensing lines 34, 36 are at levels above the syrup level 50 of the pump 14. As is well known to those skilled in the art, the level 50 would typically be the highest level of syrup maintained within the pump 14, such syrup being replenished under control of a control system or microprocessor 48 and the valve 18 in a manner readily appreciated by those skilled in the art. As shown, the microprocessor 48 also controls the dispensing valve 30 and three-way valve 22 to control the dispensing operation in a manner to be dicussed hereinafter.

It will also be appreciated that the apexes 38, 40 are maintained in close proximity to the dispensing head 46 such that the syrup levels 52 maintained in the lines 34, 36 during a quiescent period (non-dispensing period) will be between the respective apexes 38, 40 and the pump 14.

It will be appreciated that the valves 18, 22, 30 are under control of the microprocessor 48, as would be the soda dispensing system which would also be employed in conjunction with the system disclosed herein. Upon command for the dispensing of a drink, by an appropriate pour switch or the like, the three-way valve 22 is actuated to connect the pressure source 20 to the pump 14 through the conduit 24. With the pump 14 pressurized, the dispensing valve 30 is opened such that syrup may pass through the connector 32, dispensing lines 34, 36 and out of the dispensing head 46. After a full measure of beverage has been dispensed, the microprocessor 48 causes the dispensing valve 30 to close, instantaneously terminating the flow of the syrup through the dispensing lines 34, 36. Thereafter, the three-way valve 22 is actuated to disconnect the pressure source 20 from the pump 14 and to vent the pump 14 to atmosphere through the conduit 26. With the pressure released from the pump 14 and open to atmosphere, the dispensing valve 30 is again opened. With the dispensing head 46 and apexes 38, 40 positioned above the top level 50 of the syrup within the pump 14, the opening of the valve 30 causes the syrup within the downwardly extending portions 42, 44 of the dispensing lines to retract and backflow into the pump 14. The valve 30 is left open a period of time sufficient to allow a quantity of syrup to backflow to the pump 14 to cause the syrup level within the lines 34, 36 to reach the level 52 as shown in the drawing. At this point in time, the dispensing valve 30 is closed, the system 10 then sitting in a quiescent state awaiting the next dispensing cycle. As shown, the syrup levels 52 in the lines 34, 36 are below the respective apexes 38, 40 such that syrup cannot escape from the dispensing lines 34, 36 and drip from the exposed ends of those lines maintained within the dispensing head 46. It will, of course, be appreciated that it is most desirable that the apexes 38, 40 be at substantially the same height or elevation.

It should also be appreciated that the "Y" or "T" connector 32 allows the syrup levels in the dispensing lines 34, 36 to equalize as at 52. Accordingly, when the next dispensing cycle is to begin, the syrup levels in both of the dispensing lines are the same, the problems of the prior art of side-to-side syphoning having been eliminated. As a result, a single dispensing valve 30 may be employed to dispense syrup from dual lines within a dispensing head.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A syrup dispensing system for a soft drink dispenser, comprising:

a pump receiving a supply of syrup to a first level;

a first dispensing line having a first end thereof in communication with said pump, and a second end thereof maintained at a pour head, said first dispensing line having an apex defining a second level in said dispensing line, said second level being above said first level;

a first valve interposed between said first dispensing line and said pump, selectively enabling and inhibiting a flow of syrup from said pump and through said first dispensing line;

first means associated with said pump for selectively applying a pressure head to said syrup, said first means comprising a second valve selectively applying said pressure head to said syrup and venting said pump to the atmosphere to release such pressure; and control means interconnected between said first and second valves for controlling said first and second valves for dispensing syrup during a dispensing cycle, wherein said control means actuates said second valve to apply said pressure head to said syrup, opens said first valve to dispense said syrup, closes said first valve to terminate said dispensing, actuates said second valve to remove said pressure head, and thence opens said first valve for a period of time to allow syrup to withdraw from said second end of said dispensing line to a third level.

2. The syrup dispensing system according to claim 1, wherein said third level is between said first and second levels.

3. The syrup dispensing system according to claim 2, further comprising a second dispensing line having a first end thereof in communication with said pump, and a second end thereof maintained at said pour head, said second dispensing line having an apex at substantially the same level as said apex of said first dispensing line.

4. The syrup dispensing system according to claim 3, wherein said first ends of said first and second dispensing lines are joined together to a single conduit, said first valve being interposed in said conduit between said pump and a point at which said dispensing lines are joined together.

5. A syrup dispensing system, comprising:

a pump for receiving syrup and dispensing the same under pressure through a conduit;

a plurality of dispensing lines connected to said conduit and extending to a dispensing head, said dispensing lines being connected to and communicating with each other through a connector;

a valve interposed within said conduit for enabling and inhibiting a flow of syrup from said pump to said plurality of dispensing lines, wherein each of said dispensing lines has an apex between said dispensing head and said conduit, said apexes being at a first level which is above a second level of syrup maintained within said pump; and control means interconnected between said pump and said valve for controlling pressurizing and exhausting said pump and actuating said valve for initiating and terminating dispensing of syrup and a subsequent retraction of syrup within said dispensing lines to point below said apexes and between said apexes and said pump.

* * * * *